United States Patent [19]

Szilagyi et al.

[11] 4,376,906

[45] Mar. 15, 1983

[54] ELECTRODE RIBBON SEAL ASSEMBLY

[75] Inventors: Imre Szilagyi, Sunnyvale; Steven Alexander, San Jose, both of Calif.

[73] Assignee: ILC Technology, Inc., Sunnyvale, Calif.

[21] Appl. No.: 370,592

[22] Filed: Apr. 21, 1982

Related U.S. Application Data

[63] Continuation of Ser. No. 134,536, Mar. 27, 1980, abandoned.

[51] Int. Cl.[3] ..... H01J 5/50

[52] U.S. Cl. ..... 313/332; 313/217

[58] Field of Search ..... 313/220, 221, 332, 217

[56] References Cited

U.S. PATENT DOCUMENTS

| | | | |
|---|---|---|---|
| 3,278,778 | 10/1966 | Retzer | 313/332 |
| 3,753,026 | 8/1973 | Goorissen | 313/332 |
| 3,868,528 | 2/1975 | Lake et al. | 313/332 |

FOREIGN PATENT DOCUMENTS

| | | |
|---|---|---|
| 499897 | 2/1938 | United Kingdom . |
| 498617 | 1/1939 | United Kingdom . |
| 503112 | 3/1939 | United Kingdom . |
| 523923 | 7/1940 | United Kingdom . |
| 524183 | 7/1940 | United Kingdom . |
| 682376 | 11/1952 | United Kingdom . |
| 687297 | 2/1953 | United Kingdom . |
| 721621 | 1/1955 | United Kingdom . |

*Primary Examiner*—Bruce C. Anderson

*Attorney, Agent, or Firm*—Thomas E. Schatzel

[57] ABSTRACT

An improved high intensity metal halide lamp constructed from a lamp envelope assembly to which are fused a pair of mating prebeaded electrode assemblies. The lamp envelope assembly is formed from an arc discharge envelope to which are attached a pair of side arms coaxial with the arc discharge envelope and on opposite sides thereof. The prebeaded electrode assemblies are constructed from an electrode ribbon assembly which is encapsulated by vitreous quartz which has a lower hydroxyl ion content than the quartz used in the side arms of the lamp envelope.

9 Claims, 5 Drawing Figures

ELECTRODE RIBBON SEAL ASSEMBLY

This is a continuation of application Ser. No. 06/134,536, filed Mar. 27, 1980 abandoned.

BACKGROUND OF THE INVENTION

1. Field of the Invention

The invention relates generally to high intensity metal halide lamps and, particularly, to such lamps with improved structural and mechanical integrity.

2. Description of the Prior Art

High pressure mercury vapor discharge lamps with and without additional chemical additives are well-known in the prior art (for example, see U.S. Pat. No. 3,654,506 issued to Kuehl, et al.). Such lamps are commonly constructed from vitreous quartz tubing which contain electrode subassemblies. In the typical high intensity metal halide lamp, a vitreous quartz lamp envelope is filled with argon gas, mercury, plus other metal salts. Protruding into the lamp envelope are two tungsten electrodes, each electrode being connected to molybdenum foil which is in turn connected to a follower rod, which serves as an electrical termination. The tungsten electrode assemblies including the molybdenum foil are generally, but not always, concentric with the axis of the lamp envelope and located at opposite extremes of the lamp envelope. Each tungsten electrode assembly, including the molybdenum foil is encased in a vitreous quartz tube. While the discharge is actually struck between the tungsten electrodes within the sealed lamp envelope, high electrical currents are conducted to the discharge envelope through the follower rod and molybdenum foil conductors. In addition to conducting electrical excitation to the lamp envelope, the quartz arms containing the molybdenum foil attached to the tungsten electrodes also provide the mechanical support for the lamp envelope.

It has been found that lamps of this high intensity type often fail if the seal between the vitreous quartz and the molybdenum foil is not absolutely perfect. That is, in manufacture of such lamps, intimate contact between the molybdenum foil and the vitreous quartz tubular arm must be assured. If a gap or space exists between the molybdenum foil and the vitreous quartz, a high probability exists that a crack will be formed within the vitreous quartz due to the high currents flowing within the molybdenum foil causing incipient failure of the lamp.

Manufacturing processes and structures have been suggested in the prior art to achieve a molybdenum ribbon/vitreous quartz high integrity seal. One commonly used sealing method is the pinch or press seal. In the pinch or press operation the electrode ribbon assembly is supported within a thin wall quartz tube. A two-part ring burner heats the quartz tubing to soften it, and a pair of opposing pinch jaws strike the soft quartz tubing and seal it firmly to the ribbon. Because a pinch seal is made in a single operation, its maximum length is limited to an inch or less. Also, a pinch seal has little mechanical strength and cannot be used to support the relatively heavy discharge envelope.

To make a molybdenum ribbon seal air compatible it is necessary to make it long enough to insure that the end exposed to air is operating at a temperature low enough to preclude oxidation of the molybdenum quartz interface, or to provide a second seal which prevents the oxidizing atmosphere from reaching the seal.

These problems are successfully addressed in U.S. Pat. No. 3,205,395 issued to Buchwald. Buchwald teaches the construction of a high intensity lamp by using a quartz stem pressed tube incorporating a second seal to prevent oxidation of the molybdenum ribbon seal. Moreover, Buchwald teaches the insertion of the stem pressed tube into a vitreous quartz tube arm of slightly larger inside diameter than the outside dimension of the stem pressed tube. This built up assembly provides the mechanical structure which constitutes the arm attached to the lamp envelope. A gap thus results between the quartz of the stem pressed tube and the exterior quartz arm. This discontinuity in quartz is not beneficial to the performance of the lamp reducing the structural integrity of the lamp arm while not providing the heat dissipation needed for high current operation.

In an attempt to form an improved seal between the molybdenum foil and the vitreous quartz, vacuum shrinking of the quartz arm onto the molybdenum foil electrode assembly is known in the art. Typically, an electrode subassembly consisting of the tungsten electrode attached to the molybdenum foil in turn attached to the electrical terminator is inserted within a relatively thick walled vitreous quartz tube. Using techniques known in the art, the vitreous quartz tube is vacuum shrunk about the molybdenum foil assembly upon application of suitable heat. This is clearly an improvement over the stem pressed structure as taught by Buchwald since this structure can be made long enough to cause the exposed end to operate below the oxidation temperature of the molybdenum ribbon, thereby eliminating the necessity of a second seal. However, it has several practical drawbacks. To achieve the strength necessary to support the discharge envelope, the thickness of the vitreous quartz which must be shrunk onto the molybdenum foil is on the order of three millimeters and it is extremely difficult to heat such a thick-walled cylinder uniformly due to slight variations in the wall of the quartz tube. Because of the poor heat conducting properties of quartz a large temperature gradient appears between the outside surface of the tube where heat is applied and the inside surface where the seal is to be made. A temperature well in excess of the softening point is needed at the inside wall to insure that the quartz flows well onto the ribbon and into all voids. To achieve this flow on the inside surface requires that the outside surface be molten and extremely free flowing. The heating and vacuum shrinking of such thick-walled vitreous quartz about the molybdenum foil is extremely delicate, and it has been performed in practice only by skilled artisans through manual operation. Due to the delicacy of the operation, is has not been possible to automate same. A further problem which plagues seals incorporating heavy side arms is residual strain left in the quartz subsequent to the sealing. Although annealing removes a good portion of the strain, subsequent thermal cycling caused by operation of the lamp can introduce new strains in the side arms. These strains can build to the point of causing a crank in the side arm which invariably destroys the integrity of the seal and causes the lamp to fail. Even utilizing handmade techniques which are extremely expensive, high intensity lamps of the type manufactured by heat and vacuum shrinking thick-walled quartz about the molybdenum foil often fail due to molybdenum foil/vitreous quartz seal defects.

SUMMARY OF THE INVENTION

It is thus an object of the present invention to provide an improved high intensity metal halide lamp structure with significantly less failure as a result of molybdenum foil/quartz seal defects.

It is yet another object of the present invention to provide an improved high intensity metal halide lamp without defects in the molybdenum foil/quartz seal.

It is yet another object of the present invention to provide an improved high intensity metal halide lamp with an improved molybdenum foil/quartz seal that can be manufactured by automated techniques.

It is yet another object of the present invention to provide an improved high intensity metal halide lamp in which the seal components of the final structure can be tested in process so that expensive final assembly rejects are essentially eliminated.

The invention is directed to an imrpoved high intensity metal halide lamp. The improved lamp is constructed from a vitreous quartz lamp envelope assembly and a pair of prebeaded electrode assemblies. The lamp envelope assembly is assembled from a discharge envelope to which are attached a pair of side arms. The lamp envelope and side arms are generally tubular in shape and coaxial with one another with the side arms located on opposite sides of the lamp envelope from one another and integrally fused to said lamp envelope. The preformed lamp envelope assembly is adapted to receive one prebeaded electrode assembly into each side arm.

Each prebeaded electrode assembly is constructed from an electrode ribbon subassembly which is intimately sealed to a thin wall (between 0.5 and 2.0 mm) vitreous quartz tube. The electrode ribbon subassembly is made from a tungsten electrode attached to a molybdenum foil ribbon which is in turn attached to a suitable electrical terminator. The electrode ribbon subassembly is inserted within the thin wall quartz tube, and the quartz tube is thereafter vacuum shrunk about the electrode ribbon subassembly. This provides an intimate seal between the vitreous quartz of the thin wall tube and the molybdenum foil ribbon.

After trimming excess vitreous quartz from the end of the vacuum shrunk prebeaded electrode assembly, the prebeaded electrode assembly is inserted into the lamp envelope assembly with each tungsten electrode protruding into the lamp envelope. The distance between tungsten electrodes within the lamp envelope is precisely controlled. Thereafter, the vitreous quartz side arms are vacuum shrunk about the prebeaded electrode assemblies forcing an intimate seal between the vitreous quartz of the side arms and each prebeaded electrode assembly. Moreover, as the quartz of the thin wall tube has already been vacuum shrunk about the molybdenum ribbon foil in order to form the prebeaded electrode assembly, the fusing of the quartz side arms to the prebead assembly is not relied upon to form the quartz-/molybdenum ribbon foil seal. Because fusing quartz to quartz requires a lower temperature than that required in making a molybdenum foil/quartz seal, and because the prebead assembly provides some support, the fusing of the side arm to the prebead is a far more controllable operation than the conventional method of shrinking the side arm and forming the seal in one operation. However, the unexpected result of using the prebeaded electrode seal is that upon annealing the finished structure a polariscope shows the quartz of the prebead assembly to be under compression relative to the quartz of the lamp envelope even though they are fused into one solid mass. The explanation of this result appears to be that a slight difference in hydroxyl ion content between the two quartzes results in a slight expansion mismatch. The final result is a high intensity metal halide lamp of superior longevity and structural integrity due to an improved quartz/molybdenum ribbon foil seal. Moreover, as the prebeaded electrode assembly is of relatively simple geometry and the fusing of the side arms to the prebeaded electrode assemblies is no longer a delicate operation, the manufacture of such high intensity metal halide lamps may be automated which is heretofore unknown in the prior art.

It is thus an advantage of the present invention to provide a high intensity metal halide lamp with improved structural integrity.

It is another advantage of the present invention to provide a high intensity metal halide lamp with an improved quartz/molybdenum ribbon foil seal.

It is yet another advantage of the present invention to provide an improved high intensity metal halide lamp which is suitable for automation in manufacture thus eliminating the high cost of hand craftsmanship.

These and other objects and advantages of the present invention will no doubt become apparent to those skilled in the art by referring to the following description of a preferred embodiment and the several drawing figures.

DESCRIPTION OF THE PREFERRED EMBODIMENT

Figure 1:
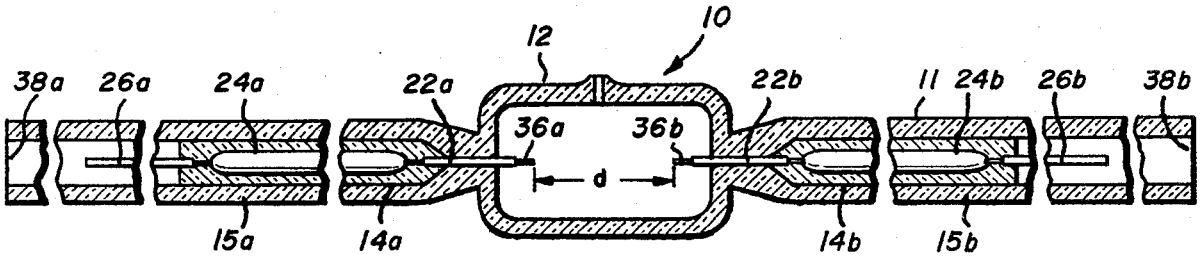
FIG. 1 is a cross-sectional view along the longitudinal axis of the lamp of the present invention.

While the present invention is applicable to many high intensity lamp structures, it has been utilized successfully in the manufacture of medium arc length high intensity lamp assemblies ranging in power from 575 watts to 4000 watts. FIG. 1 illustrates a high intensity metal halide lamp assembly according to the present invention and referred to by the general reference character 10. Lamp 10 is constructed from a lamp envelope assembly 11 having a cylindrical arc tube envelope 12 and a pair of prebeaded electrode assemblies **14*a* and 14*b* within a pari of side arms 15*a* and 15*b*, respectively. The arms 15*a* and 15*b* are coaxial with the envelope 12**.

Figure 2:
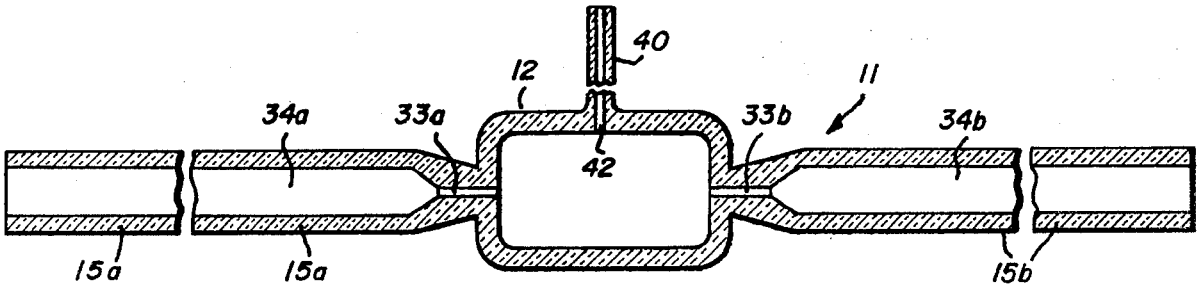
FIG. 2 is a cross-sectional view along the longitudinal axis of the lamp envelope assembly of the lamp of FIG. 1.
Figure 3:
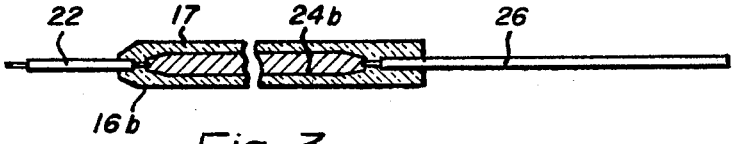
FIG. 3 is a cross-sectional view along the longitudinal axis of a prebeaded electrode assembly.

FIG. 2 illustrates a cross-sectional view of the lamp envelope assembly 12 prior to insertion of the prebeaded electrode assemblies **14*a* and 14*b*. FIG. 3 illustrates a cross-sectional view of the prebeaded electrode assembly 14*b* of the lamp 10. Electrode assembly 14*b* is a mirror image of electrode assembly 14*a*. Lamp envelope assembly 12 is adapted to matingly receive the prebeaded electrode assemblies 14*a* and 14*b* such that said prebeaded electrode assemblies 14a and 14b are each intimately fused to the arms 15a and 15b, respectively to the lamp envelope assembly 12**.

Figure 4:
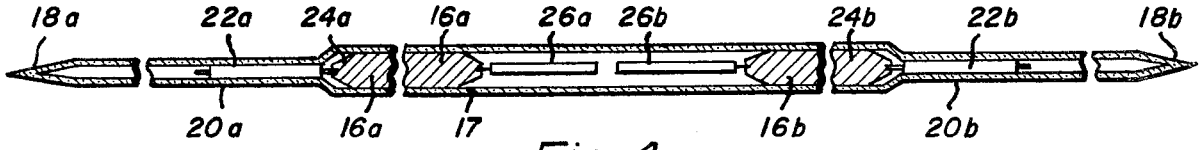
FIG. 4 is a cross-sectional view along the longitudinal axis illustrating insertion of prebeaded electrode assemblies into a thin wall quartz tube.

Referring to FIG. 4, a pair of electrode ribbon assemblies 16a and 16b are shown inserted into opposite ends of a thin wall quartz tube 17 prior to closing on end 18a and 18b of a pair of segments 20a and 20b, respectively, integral with the tube 17. The electrode ribbon assemblies 16a and 16b include tungsten electrodes 22a and 22b attached to molybdenum ribbon foils 24a and 24b. The foils 24a and 24b are in turn attached to electrical terminators 26a and 26b. Electrode ribbons 16a and 16b are adapted to be slideably received by the thin wall quartz tube 17 and positioned with the tungsten electrodes 22a and 22b in the segments 20a and 20b respectively.

Figure 5:
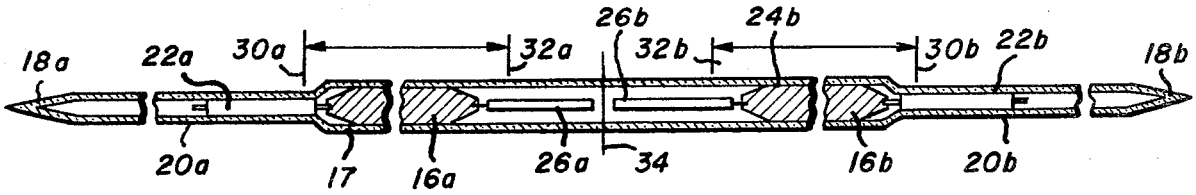
FIG. 5 is a cross-sectional view along the longitudinal axis of the structure of FIG. 4 illustrating slicing of the structure after vacuum shrinking of the electrode ribbon assemblies.

Referring to FIG. 5, a vacuum shrinking operation is performed upon electrode ribbon assembly 16a between a plane 30a and a plane 32a. Likewise, a similar vacuum shrinking operation is performed for electrode ribbon assembly 16b between a plane 30b and 32b. Thereafter, the structure of FIG. 5 is cut through a plane 34 to form the two electrode subassemblies 14a and 14b. At this point the seals about the electrodes can be checked using a standard gas leak detector. After cutting the structure shown in FIG. 5 through the plane 34, vitreous quartz is removed from contact with the electrode ribbon assembly 16a and 16b in all areas other than between the points of planes 30 and 32 and between the points of the planes 30b and 32b. Upon removal of said vitreous quartz the prebeaded electrode assembly 14a and 14b similar to that as illustrated in FIG. 3 is formed.

The prebeaded electrode assemblies 14a and 14b are inserted into the arms 15a and 15b of the lamp envelope assembly 12. An end 36a of the electrode 22a and an end 36b of the electrode 22a terminate within the arc discharge envelope 12. Referring to FIG. 1, once assembled, the distance "d" between the end 36a of the tungsten electrode 22a and the end 36b of the tungsten electrode 22b must be set. The distance "d" significantly affects the operating characteristics of high intensity metal halide lamps. For example, for a 4000 watt high intensity metal halide lamp the distance between electrode end 36a and 36b is approximately 35.60 millimeters ±0.25 millimeters.

Maintaining the tolerance of such electrode spacing as tightly as ±0.25 millimeters is difficult in the prior art metal halide lamps, because the electrode ribbon assemblies in prior art high intensity metal halide lamps are generally inserted directly into a thick-walled side arm, and the thick-walled side arm tubes are thereafter vacuum shrunk about the respective ribbon electrode assemblies. Not only is it difficult to vacuum shrink a thick-walled vitreous quartz side arm when the wall thickness is typically on the order of three millimeters, but it is also extremely difficult to adjust the electrode gap spacing. The electrode ribbon assemblies when not in a prebeaded electrode assembly are extremely flexible. This makes it difficult to adjust the arc gap spacing if pushing upon the end opposite from electrode ends of the electrode ribbon assemblies is necessary. The problem is directly analogous to the classic mechanical dilemma of "pushing on rope."

With the present invention each prebeaded electrode assembly 14a and 14b is rigid and it is a simple matter to exert force on the end of each prebeaded electrode assembly 14a and 14b so as to position the ends 36a and 36b into the proper distance "d" relationship.

Referring to FIG. 1, the side arms 15a and 15b each have a terminal end 38a and 38b, respectively. In manufacturing the high intensity metal halide lamp 10 the ends 38a and 38b are vacuum sealed. Thereafter, it is possible to complete a vacuum in the envelope by connection of a tubulation arm 40 at a portal 42 as illustrated by FIG. 2. By appropriately applying heat to the side arm assemblies 15a and 15b which in turn heat prebeaded electrode assemblies 14a and 14b, respectively, a generally perfect seal is uniformly created between side arms 15a and 15b and prebeaded electrode assemblies 14a and 14b, respectively.

In completing the assembly of the high intensity metal halide lamp 10, it is only necessary to fill the lamp envelope 11 with the proper components of argon, mercury, and metal salts, thereafter remove tubulation arm 40 and seal the envelope at portal 42. In addition, it is necessary to cut the vitreous quartz at the appropriate ends 38a and 38b of the arms 15a and 15b, respectively, so as to expose the electrical terminators 26a and 26b in order that the electrical connections for the end caps (not shown) can be made.

Prebeaded electrode assemblies similar to the prebeaded electrode assemblies 14a and 14b as described here may be applied to a high intensity metal halide lamp where (1) an intimate, defect-free seal between the vitreous quartz (or other like material) and a molybdenum ribbon foil (or other like material) is required and (2) significant temperature gradients causing residual internal stresses would result if a thick-walled cylinder was merely vacuum shrunk around a bare electrode ribbon assembly. Practically speaking, many high intensity metal halide lamps of the prior art fail due to imperfections at the vitreous quartz/molybdenum ribbon foil seal or due to thermally induced tensile stresses which cause side arm cracking clear through the seal. Structures of the present invention avoid these problems.

Apart from the advantage of the improved structural integrity of lamp 10, the construction of lamp 10 lends itself to automated production techniques. Prior art lamps are known to be constructed by skilled artisans in manual operations due to the delicacy of the vitreous quartz vacuum shrinking and/or fusing operations. Due to the manual labor required to construct prior art lamps, such lamps are extremely expensive. One factor which significantly contributes to the need for highly skilled manual labor to construct such prior art lamps is the fact that heat shrinking thick-walled tubing of approximately three millimeters thickness directly onto the molybdenum foil of electrode ribbon assemblies 16a and 16b is difficult. In producing the high intensity metal halide lamp 10 of the present invention, it is only necessary to vacuum shrink vitreous quartz with a wall-thickness of approximately one-third that of prior art side arms when making the molybdenum foil/quartz seal. Because the vacuum shrinking operations are performed in two steps:

(1) formation of the prebeaded electrode assemblies 14a and 14b and (2) vacuum shrinking of the side arms 15a and 15b to the prebeaded electrode assemblies 16a and 16b, it eliminates the problems of internal residual stresses in the vitreous quartz of the prebeaded electrode assembly (i.e., it is a vitreous quartz/vitreous quartz bond). Eliminating the delicate operation of attempting to vacuum shrink and fuse thick-walled quartz while simultaneously forming a molybdenum foil/quartz seal permits the realization of automated techniques in the production of both prebeaded electrode assemblies 14*a* and 14*b* and lamp envelope assembly 11. Such automated techniques significantly reduce the cost of lamps produced in accordance with the present invention.

In addition to the improved high intensity metal halide lamp as described above, a further unexpected advantage results in the expansion coefficient of the quartz of the side arm exceeds the expansion coefficient of the quartz of the prebeaded electrode assembly. Typically, prior art lamps utilize the same quartz for all lamp components. It has been shown that the lamp of the present invention may be succesfully constructed with all its attendant advantages when in fact all quartz is of identical composition and identical material properties. However, it is well known that quartz is strong in compression and relatively weak (i.e., susceptible to cracking) in tension. Thus, tensile stresses should be avoided to achieve a lamp of superior longevity. In this regard, it has been found that if the expansion coefficient of the quartz used to construct the side arms 15*a* and 15*b* exceeds the expansion coefficient of the glass used in the tube 17 to construct the prebeaded electrode assemblies, the resulting structure after integral fusing of the side arms to the prebeaded electrode assemblies and annealing exhibits compression about the prebeaded electrode assemblies. This results in a lamp of unparalleled mechanical integrity which is not otherwise achievable by prior art techniques.

In choosing quartz material for particular thermal expansion characteristics the hydroxyl ion content is a known parameter which affects quartz thermal expansion rate. The higher the hydroxyl ion content, the higher the expansion rate. The addition of other impurities to quartz additionally increases the thermal expansion rate. In the final result, it is only necessary to choose quartz materials where the expansion rate of the side arm quartz exceeds the expansion rate of the prebeaded electrode assembly quartz, but the difference in expansion coefficients should not exceed ten percent. If the difference in expansion coefficients exceeds ten percent, the side arms may crack under thermal cycling.

For the sake of clarity, and in order to disclose the invention so that the same can be readily understood, a specific embodiment has been described and illustrated. However, it is to be understood that the present invention is not limited to the specific means disclosed. It may be embodied in other ways that will suggest themselves to persons skilled in the art. It is believed that this invention is new and that all such changes that come within the scope of the following claims are to be considered as part of this invention.

What is claimed is:

1. An improved high-intensity lamp, comprising:

a glass arc tube envelope forming a cavity adapted to receive a pair of electrodes therein;

a pair of glass side arms rigidly fused to said arc tube envelope, each of the side arms being adapted to receive one prebeaded electrode assembly therewithin; and a pair of prebeaded electrode assemblies, each of said prebeaded electrode assemblies being pre-constructed from an electrode ribbon assembly consisting of a ribbon foil conductor attached to an electrode on one end and to an electrical termination on the other end, said electrode ribbon assemblies being encased and sealed within a glass sleeve vacuum shrunk about said ribbon foil conductor, a part of said electrode, and part of said electrical termination prior to the insertion of said prebeaded electrode assemblies into said side arms, wherein said prebeaded electrode assemblies are intimately fused to said sidearms with said electrodes protruding into said arc tube envelope to strengthen the resulting structure.

2. The high intensity lamp of claim 1, wherein said glass is vitreous quartz.

3. The high intensity lamp of claim 1, wherein said ribbon foil conductors are constructed from molybdenum, and said electrodes and said electrical terminations are constructed from tungsten.

4. The high intensity lamp of claim 1, wherein said side arms are coaxial with each other and coaxial with said arc tube envelope.

5. The high intensity lamps as recited in claim 1, 2, or 3, wherein the thermal expansion coefficient of the vitreous quartz of said side arms exceeds the thermal expansion coefficient of the vitreous quartz of said prebeaded electrode assemblies by ten percent or less.

6. A high intensity metal halide lamp comprising:

a vitreous quartz envelope assembly having a central discharge envelope and a pair of side arms with one of said side arms projecting laterally from opposite sides of said central discharge envelope:

a first and a second prebeaded electrode assembly, each of the prebeaded electrode assemblies including a conductive ribbon foil vacuum sealed intimately within a vitreous quartz tubing and having a therminal electrode assembly being positioned within one of said side arms and said second prebeaded electrode assembly being positioned within the other said side arms with a terminal electrode terminating within said discharge envelope; and vacuum sealing means sealing the side arms about the first and second prebeaded electrode assemblies to strengthen the resulting structure.

7. The lamp of claim 6 wherein the prebeaded electrode assemblies include a molybdenum ribbon foil with said vitreous quartz tubing heat shrunk about the electrode ribbon assembly, the electrode ribbon assembly being coaxial with said vitreous quartz tubing.

8. The lamp of claim 7 wherein said central discharge envelope is cylindrical and each pair of side arms are cylindrical and coaxial with said central discharge envelope.

9. In a high intensity metal halide lamp constructed from an arc tube envelope attached concentrically and on opposite ends to a pair of side arms, said side arms each containing a molybdenum foil ribbon attached to a tungsten electrode on one end and a suitable electrical termination on the other end, the improvement comprising:

a pair of pre-beaded electrode assemblies each constructed prior to insertion into the side arms from an electrode ribbon assembly consisting of a molybdenum ribbon with a tungsten electrode attached to one end and an electrical termination attached to the other end with vitreous quartz vacuum shrunk about and intimately sealed with said electrode ribbon assembly;

a pair of vitreous quartz side arms each adapted to receive one of said prebeaded electrode assemblies concentrically therewithin; and each of said prebeaded electrode assemblies being vacuum fused to one of said side arms, thereby forming an intimate seal therebetween with a tungsten electrode protruding therefrom into the arc tube envelope and strengthening the resulting structure.

* * * * *